US010619285B2

(12) United States Patent
Asami

(10) Patent No.: US 10,619,285 B2
(45) Date of Patent: Apr. 14, 2020

(54) CONTROL METHOD OF WASHING MACHINE

(71) Applicants: QINGDAO HAIER WASHING MACHINE CO., LTD., Qingdao, Shandong (CN); AQUA CO., LTD, Chiyoda-ku, Tokyo (JP)

(72) Inventor: Masahiko Asami, Tokyo (JP)

(73) Assignees: QINGDAO HAIER WASHING MACHINE CO., LTD., Qingdao, Shandong (CN); AQUA CO., LTD, Chiyoda-ku, Tokyo (JP)

( * ) Notice: Subject to any disclaimer, the term of this patent is extended or adjusted under 35 U.S.C. 154(b) by 140 days.

(21) Appl. No.: 16/065,786

(22) PCT Filed: Dec. 23, 2016

(86) PCT No.: PCT/CN2016/111802
§ 371 (c)(1),
(2) Date: Jun. 22, 2018

(87) PCT Pub. No.: WO2017/107989
PCT Pub. Date: Jun. 29, 2017

(65) Prior Publication Data

US 2019/0003100 A1 Jan. 3, 2019

(30) Foreign Application Priority Data

Dec. 24, 2015 (JP) ..... 2015-251163

(51) Int. Cl.
*D06F 37/24* (2006.01)
*D06F 35/00* (2006.01)
(Continued)

(52) U.S. Cl.
CPC ..... *D06F 37/245* (2013.01); *D06F 33/02* (2013.01); *D06F 35/007* (2013.01); *D06F 37/14* (2013.01);
(Continued)

(58) Field of Classification Search
CPC .. D06F 33/02; D06F 35/007; D06F 37/14245; D06F 2202/10; D06F 2202/12;
(Continued)

(56) References Cited

U.S. PATENT DOCUMENTS 2,534,269 A * 12/1950 Ellner ..... D06F 37/225 74/572.4
3,610,069 A * 10/1971 Tanner ..... D06F 37/24 74/523
(Continued)

FOREIGN PATENT DOCUMENTS

CN 1197863 A 11/1998
CN 102560965 A 7/2012
(Continued)

OTHER PUBLICATIONS

Extended European Search Report and Written Opinion dated Dec. 10, 2018 regarding EP16877799.3.
(Continued)

*Primary Examiner* — Joseph L. Perrin
(74) *Attorney, Agent, or Firm* — Arent Fox LLP

(57) ABSTRACT

Provided is a control method of a washing machine. The control method of the washing machine including: an unbalanced position detection for detecting an unbalanced position; a balancer selection for determining a baffle plate which requires for water injection; a first water injection for injecting adjusted water to the baffle plate farthest away from the unbalanced position by a water supply valve when water needs to be injected to at least two baffle plates; an
(Continued)

unbalance amount detection for detecting a transition of the unbalance amount of the washing tub; and a water injection switching for switching the water injection from the water supply valve to a water supply valve when the unbalance amount detected by the unbalance amount detection has turned to an increase.

8 Claims, 10 Drawing Sheets

(51) Int. Cl.
*D06F 33/02* (2006.01)
*D06F 37/14* (2006.01)

(52) U.S. Cl.
CPC ..... *D06F 2202/10* (2013.01); *D06F 2202/12* (2013.01); *D06F 2204/086* (2013.01); *D06F 2204/10* (2013.01); *D06F 2222/00* (2013.01)

(58) Field of Classification Search
CPC ..... D06F 2204/10; D06F 2204/086; D06F 2222/00
See application file for complete search history.

(56) References Cited

U.S. PATENT DOCUMENTS 5,280,660 A * 1/1994 Pellerin ..... D06F 37/225 68/12.06
5,782,110 A * 7/1998 Kim ..... D06F 37/245 68/23.3
5,829,084 A * 11/1998 Fujiwara ..... D06F 37/245 8/158
5,855,127 A * 1/1999 Kohara ..... D06F 37/245 68/23.2
8,695,381 B2 * 4/2014 Moore ..... D06F 37/203 68/12.06
8,713,977 B2 * 5/2014 Verma ..... D06F 37/225 68/23.2
8,991,223 B2 * 3/2015 Erickson ..... D06F 37/225 68/23.2
9,003,838 B2 * 4/2015 Ostdiek ..... D06F 37/225 68/12.06
9,303,352 B2 * 4/2016 Hasanreisoglu ..... D06F 37/06
2011/0120192 A1 * 5/2011 Song ..... D06F 37/245 68/23.2
2014/0223969 A1 8/2014 Kim et al.

FOREIGN PATENT DOCUMENTS

EP 1736589 A2 12/2006
EP 3351675 A1 7/2018
JP 1024186 A 1/1998
JP 2001062185 A 3/2001
JP 09-290089 A 4/2009
JP 05650927 B2 1/2015
WO 2011080119 A1 7/2011

OTHER PUBLICATIONS

International Search Report and Written Opinion dated Apr. 1, 2017, regarding PCT/CN2016/111802.

* cited by examiner (A)
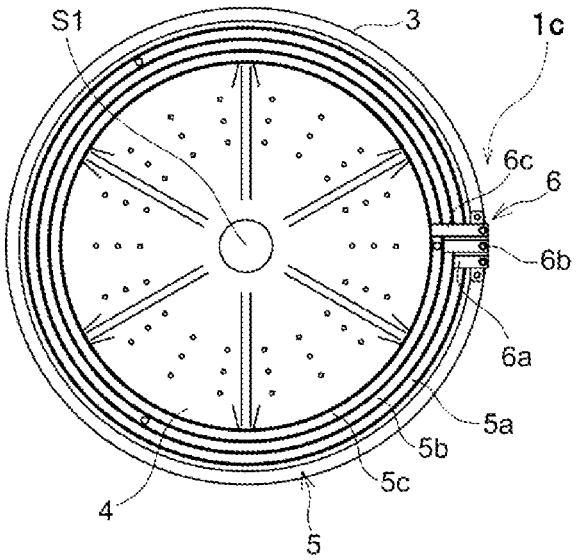
(B)
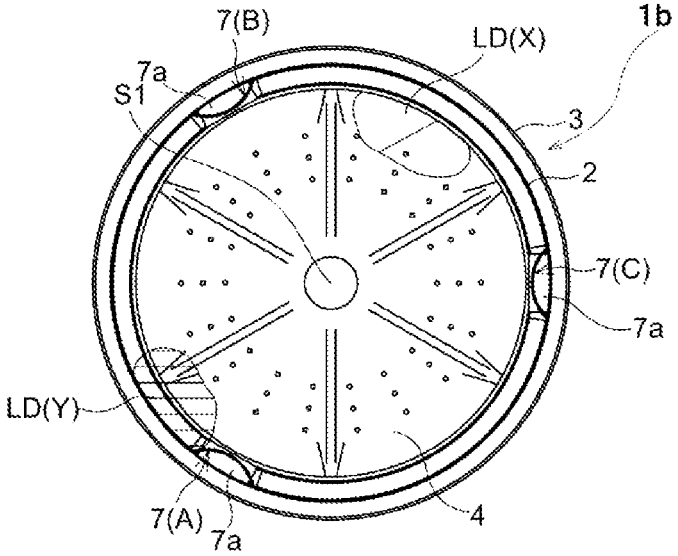
FIG. 4

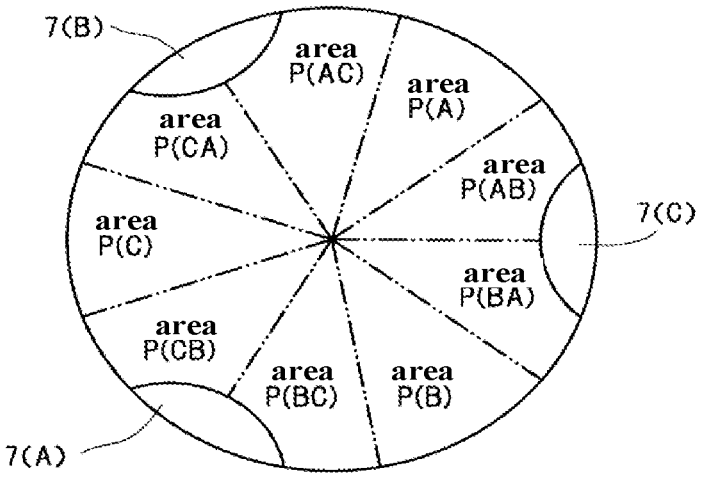

| Area Y | Water supply valve X | Water supply valve Z | Target baffle plate |
|---|---|---|---|
| area P(A) | water supply valve 26a | ———— | A |
| area P(AB) | water supply valve 26a | water supply valve 26b | A→B |
| area P(BA) | water supply valve 26b | water supply valve 26a | B→A |
| area P(B) | water supply valve 26b | ———— | B |
| area P(BC) | water supply valve 26b | water supply valve 26c | B→C |
| area P(CB) | water supply valve 26c | water supply valve 26b | C→B |
| area P(C) | water supply valve 26c | ———— | C |
| area P(CA) | water supply valve 26c | water supply valve 26a | C→A |
| area P(AC) | water supply valve 26a | water supply valve 26c | A→C |

FIG. 9

CONTROL METHOD OF WASHING MACHINE

CROSS-REFERENCE TO RELATED APPLICATIONS

This application is a National Stage Entry of PCT/CN2016/111802, filed Dec. 23, 2016, which claims priority to Japanese Patent Application No. 2015-251163 filed on Dec. 24, 2015, the disclosures of which are hereby incorporated by reference in their entirety.

TECHNICAL FIELD

The present disclosure relates to a control method of a washing machine capable of eliminating an unbalance of a washing tub in a dehydration process and suppressing vibrations and noises caused by an eccentricity of the washing tub during dehydration.

BACKGROUND

As for ordinary washing machines installed in households or laundromats, vibrations and noises are generated when laundry is biased in a dehydration tub during dehydration. The vibrations and noises may develop into trouble depending on the installation location of the washing machine and the surrounding environment. In addition, when the biasing of the laundry is relatively large, the eccentricity of the washing tub at the time of rotation becomes large, and a large torque is required for rotation, so that the dehydration operation cannot be started.

In view of this, a first conventional technique includes detecting an unbalance amount and an unbalanced position of clothes in a washing tub during dehydration and braking the rotation of the washing tub to lower the centrifugal force when there is unbalance, so that the lumps of the clothes that cause the unbalance fall by gravity and are dispersed.

In addition, a second conventional technique includes determining whether there is unbalance in a washing tub during a low-speed rotation, stopping the motor when the unbalance is detected and injecting water into the washing tub to release the lumps of clothes for eliminating the unbalance.

However, in the first conventional technique, an unbalance detection and a dispersion operation can be performed only when the dehydration tub rotates at a low speed in the dehydration processing, and the unbalance may occur again due to the influence of the type of clothes and the like after the start of the high-speed rotation of the dehydration tub.

Further, in the first and second conventional techniques, when the unbalance is detected, the rotation of the dehydration tub is decelerated or stopped, so that every time the dehydration operation is repeated, a starting power is required. Not only the power consumption is large, but also the time required for washing, i.e. the operation time, is delayed. Furthermore, in the second conventional technique, the power consumption is increased, besides, a problem exits that water consumption is also increased.

In the washing machine installed in the laundromat, in particular, the above-described delay in the driving time leads to a decrease in the circulation efficiency of the customer in the store.

SUMMARY

The present disclosure may effectively solve such problems, and the present disclosure may provide a control method of a washing machine to eliminate the unbalance of the washing tub without slowing down or stopping the rotation even if the laundry is unevenly distributed in the dehydration tub during the dehydration operation. Vibrations and noises generated by the eccentricity of the washing tub are suppressed and delays in operation time are effectively avoided.

The present disclosure takes the following measures in view of the above problems.

That is, the control method of the washing machine in the present disclosure is the control method of the washing machine described below, the washing machine includes: three or more hollow balancers provided with different angular phases around an axis at an inner circumferential surface of a washing tub; and a water injection device for injecting adjusted water into each of the balancers individually. The control method of the washing machine includes, in a dehydration process, an unbalanced position detection for detecting an unbalanced position of the washing tub; a balancer selection for determining the balancers that requires for water injection based on the unbalanced position detection step; a first water injection for injecting the adjusted water into an arbitrary first balancer among a plurality of balancers when water injection is required for at least two of the balancers in the balancer selection step; an unbalance amount detection for detecting a transition of the unbalance amount of the washing tub during the first water injection step; a water injection switching for switching the water injection of the adjusted water from the first balancer to a second balancer when the unbalance amount detected by the unbalance amount detection turns into an increase; and a second water injection for injecting the adjusted water into the second balancer.

Further, the first balancer is a balancer that is located at a position having a furthest distance from the unbalanced position.

Further, the control method of the washing machine includes: a time switching for switching the water injection of the adjusted water from the first balancer to the second balancer when a predetermined time has elapsed from the first water injection to the water injection switching.

Further, the each of the balancers is a baffle plate protruding from the inner circumferential surface of the washing tub and capable of stirring a laundry.

Further, the balancers are provided at equal angle intervals along the inner circumferential surface of the washing tub.

According to the present disclosure described above, even when water injection is required for a plurality of balancers, the time required for water injection is suitable for eliminating unbalance. Thus, it is possible to prevent the time required for eliminating the unbalance from being too long, and the dehydration process is smoothly performed. That is, according to the present disclosure, even if the laundry is biased inside the washing tub at the time of the dehydration operation, the unbalance of the washing tub can be eliminated without slowing down or stopping the rotation, the vibrations or noises generated by the eccentricity of the washing tub can be suppressed, and the delay of the operation time can be effectively avoided. As a result, since the time required for washing by a user is not delayed, it is advantageous to the utilization of the user's time and the improvement of the rotation efficiency of the laundromat.

Further, according to the present disclosure in which the first balancer is a balancer that is located at a position having a furthest distance from the unbalanced position, the unbalance amount is promptly reduced by injecting water into the balancer that most contributes to the elimination of unbalance, and a necessary time for injecting water is ensured by the water injection switching, thereby contributing to a quicker elimination of unbalance.

Further, according to the present disclosure having such a time switching, even if the water injection into the first balancer has a low level of unbalance relief, an excessively long time for the water injection is avoided, and it is more advantageous to the elimination of unbalance.

Further, according to the present disclosure in which the balancer is a baffle plate capable of agitating the laundry, by effectively utilizing the existing configuration, the upsizing of the device is avoided, and the increasing in the number of parts to be manufactured also can be effectively avoided, which also contributes to manufacturing with a higher efficiency.

Further, according to the present disclosure in which the balancers are provided at equiangular intervals, a control from the determination of the unbalanced position to the determination of the balancer requiring water injection is simply performed, so that the elimination of the unbalance can be performed efficiently.

BRIEF DESCRIPTION OF DRAWINGS

FIG. 4 is a view of a part of the same washing machine 1 observed from top;

FIG. 9 is a diagram for explaining the flow of control in the dehydration process of the same washing machine 1.

DETAILED DESCRIPTION

An embodiment of the present disclosure will be described in detail below with reference to the drawings.

Figure 1:
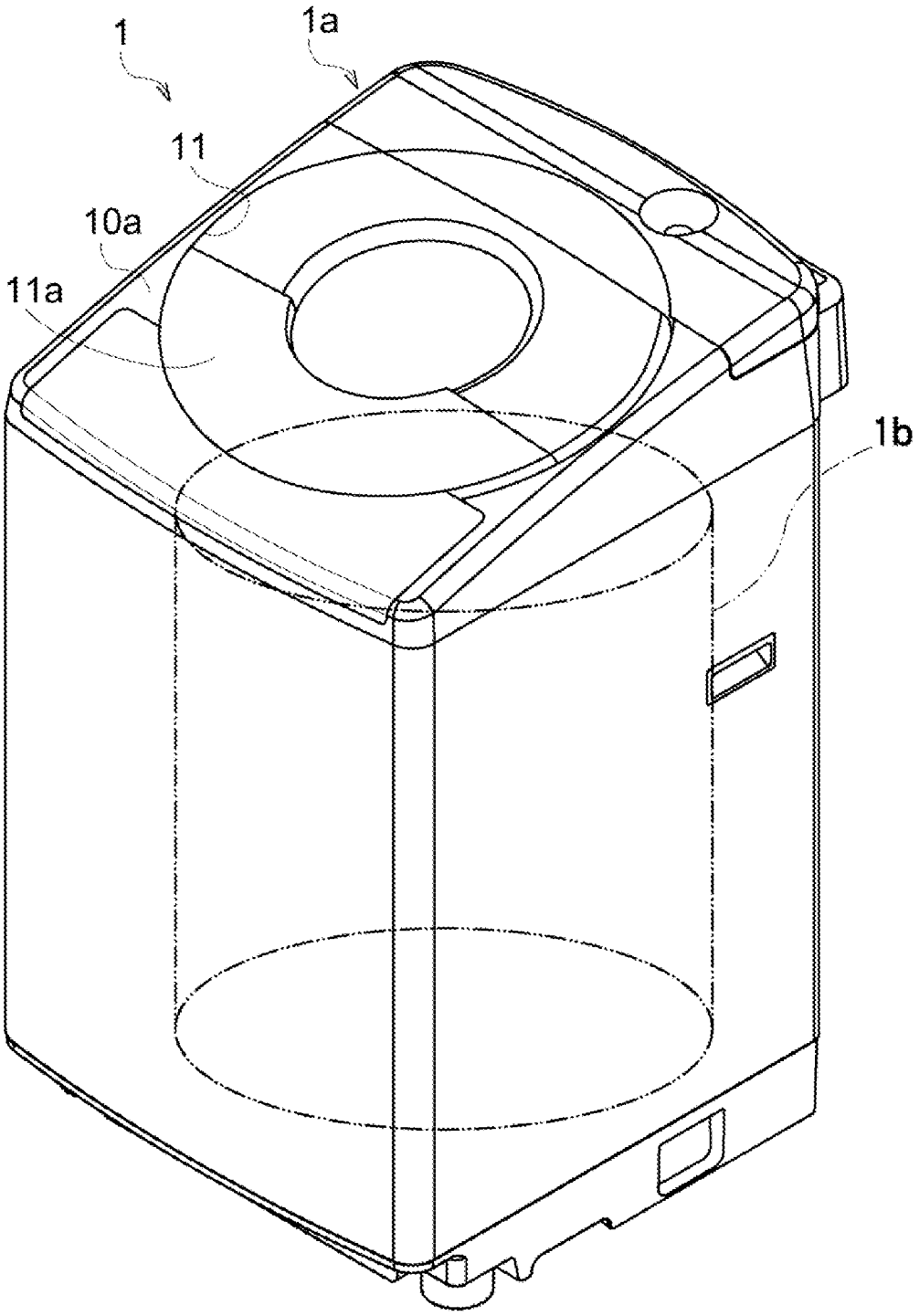
FIG. 1 is a perspective view showing an appearance of a washing machine 1 according to one embodiment of the present disclosure.
Figure 2:
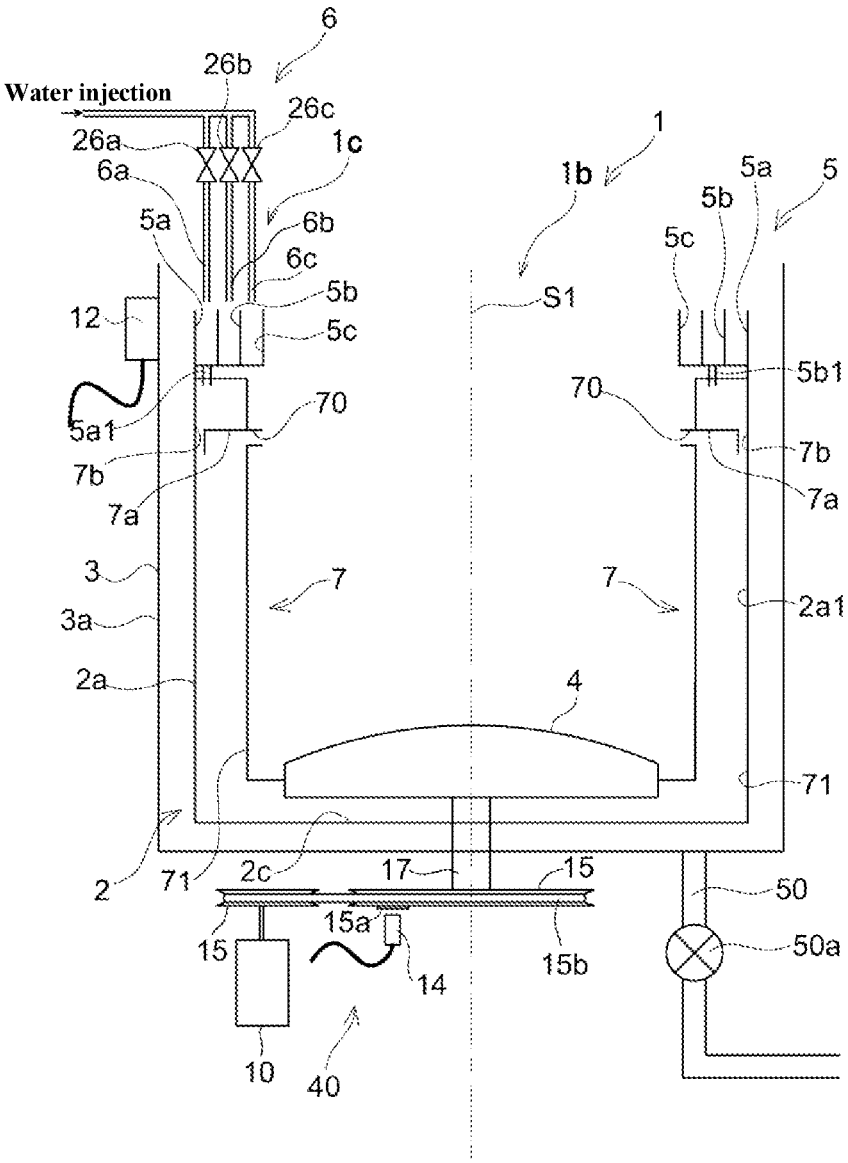
FIG. 2 is a schematic diagram showing structures of the same washing machine 1.
Figure 3:
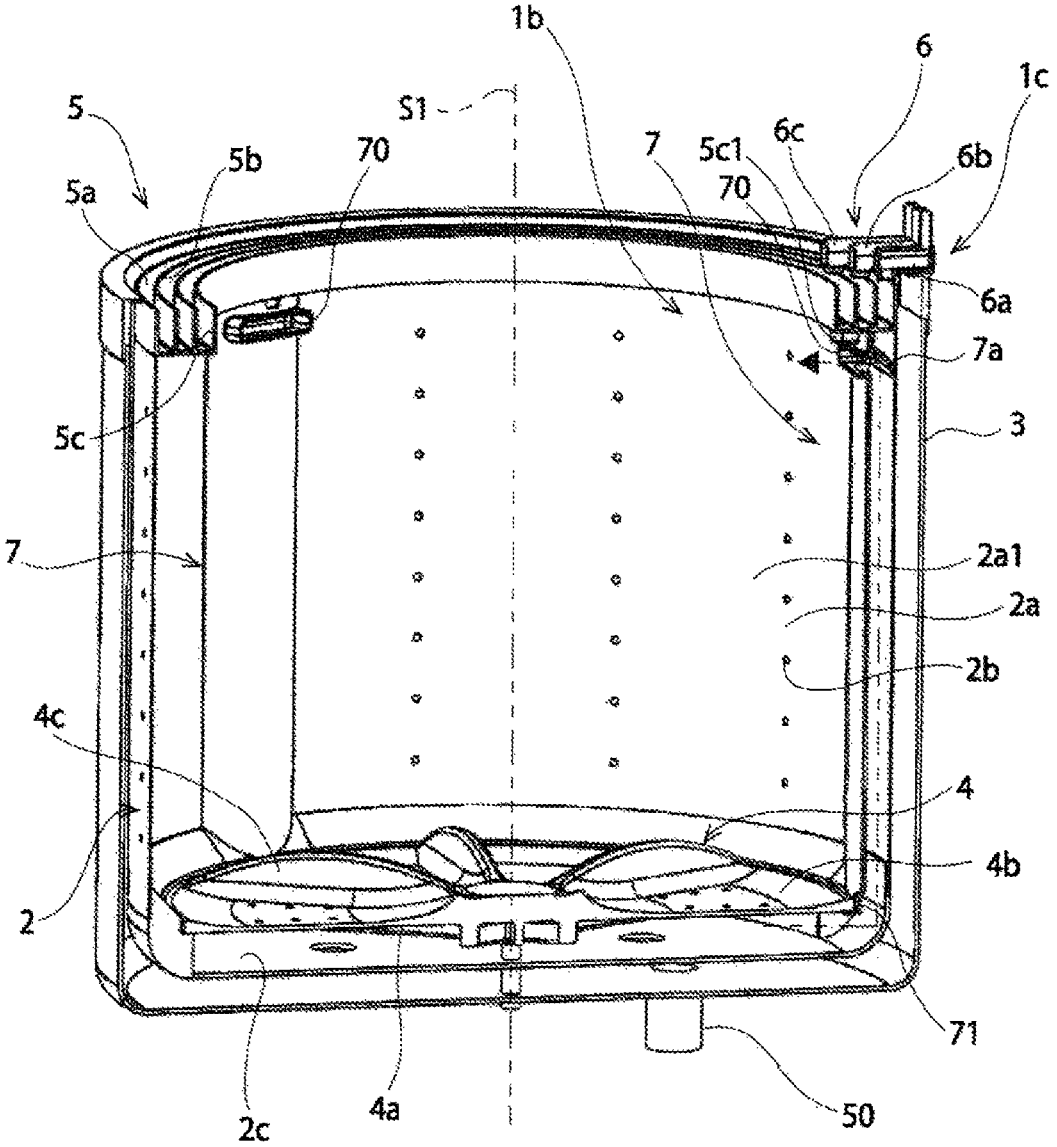
FIG. 3 is a partial vertical cross-sectional perspective view of the same washing machine 1.
Figure 5:
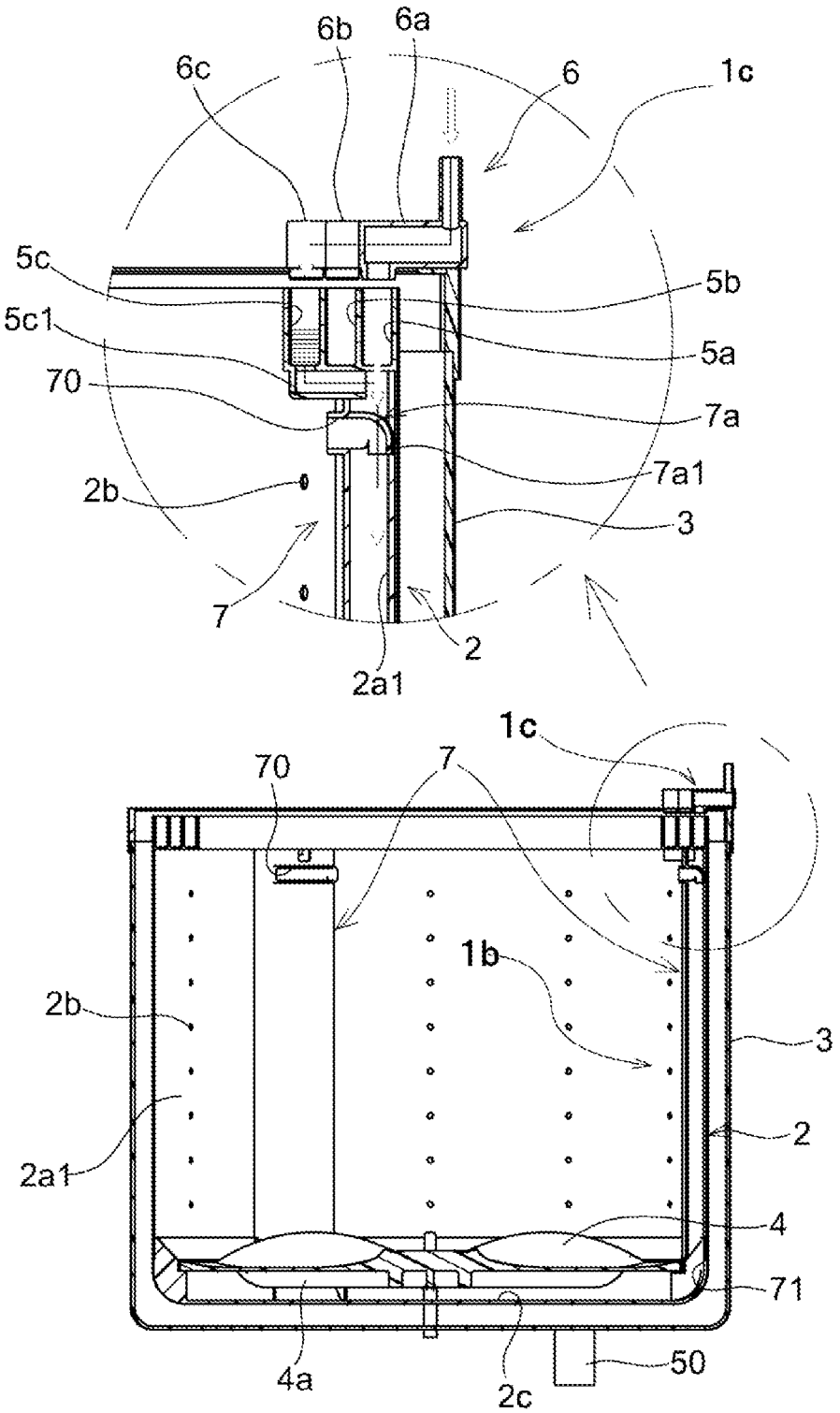
FIG. 5 is a partial vertical sectional view of the same washing machine 1.

FIG. 1 is a perspective view showing the appearance of a vertical type washing machine (hereinafter referred to as "washing machine") 1 according to one embodiment of the present disclosure. FIG. 2 is a schematic diagram showing the structures of the washing machine 1 of the present embodiment. FIG. 3 is a partial vertical cross-sectional perspective view of the washing machine 1 of the present embodiment. FIG. 4 is a view of a part of the washing machine 1 observed from top. FIG. 4(A) is a plan view, and FIG. 4(B) is a transverse sectional view of the dehydration tub 2 of the washing machine 1. FIG. 5 is a partial vertical sectional view of the washing machine 1 of the present embodiment.

Figure 6:
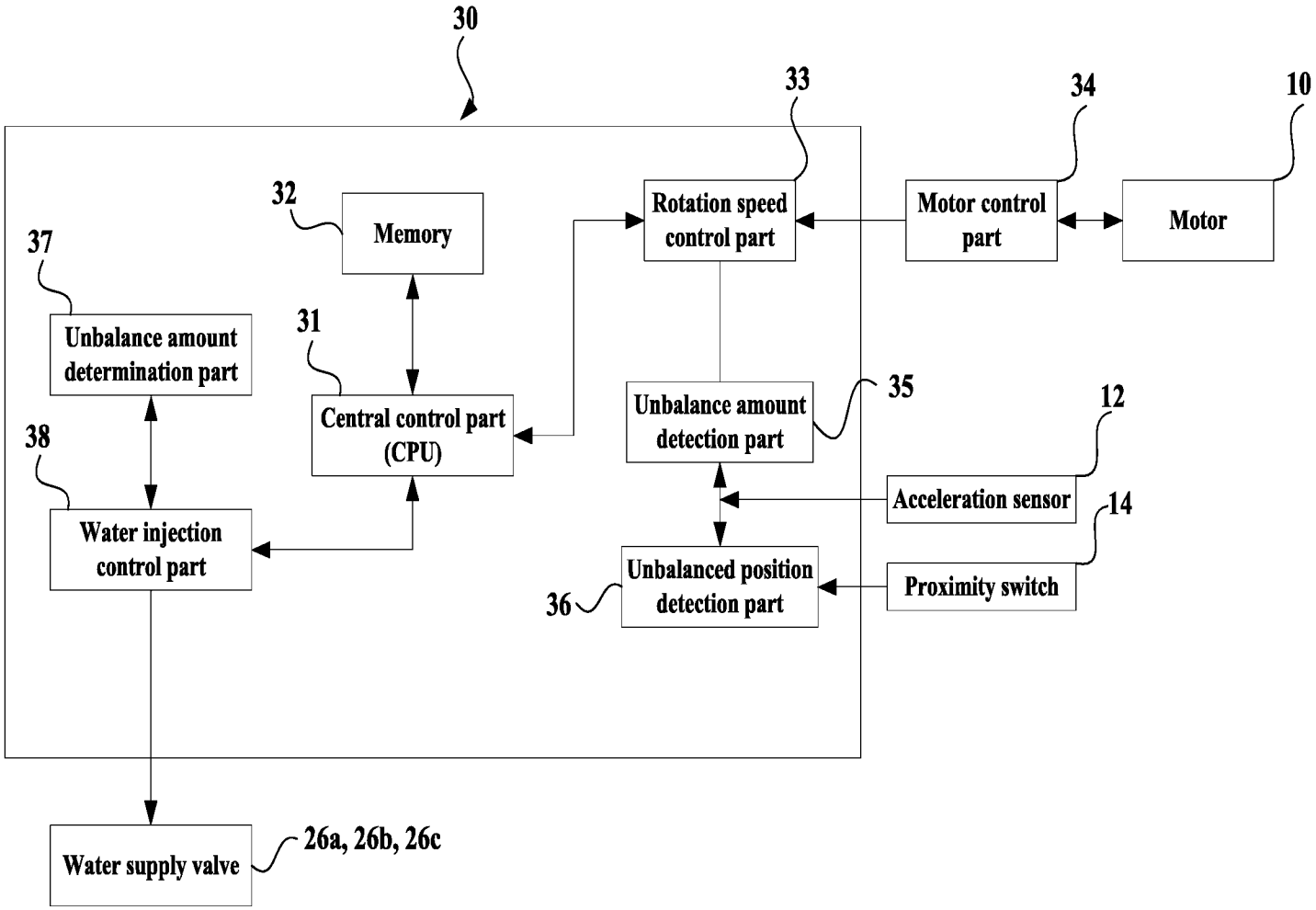
FIG. 6 is an electrical system block diagram of the same washing machine 1.

The washing machine 1 of the present embodiment includes: a washing machine main body 1*a*, an outer tub 3 and a dehydration tub 2 constituting a washing tub 1*b*, a water receiving ring unit 5, a nozzle unit 6, a driving part 40 and a control device (See FIG. 6).

The washing machine body 1*a* shown in FIG. 1 has a substantially cuboid shape. On the upper surface 10*a* of the washing machine main body 1*a*, an opening 11 for throwing in and taking out the laundry into and from the dehydration tub 2 is formed, and an opening and closing a lid 11*a* capable of opening and closing the opening 11 is attached.

The outer tub 3 is a bottomed tubular member constituting the profile of the washing tub 1*b* disposed inside the washing machine main body 1*a* and is capable of storing the washing water therein. As shown in FIG. 2, on the outer circumferential surface 3*a* of the outer tub 3, an acceleration sensor 12 capable of detecting accelerations in horizontal and vertical directions is attached.

The dehydration tub 2 is disposed coaxially with the outer tub 3 inside the outer tub 3, constitutes a washing tub 1*b* together with the outer tub 3, and is a bottomed tubular member supported a freely rotatable manner. The dehydration tub 2 can accommodate the laundry therein, and has a large number of water-passing holes 2*b* (see FIG. 3) on its wall surface 2*a*.

A pulsator (stirring blade) 4 is freely rotatably disposed at the center of the bottom 2*c* of such a dehydration tub 2. As shown in FIG. 3, the pulsator 4 includes: a substantially disc-shaped pulsator main body 4*b*, a plurality of upper vane portions 4*c* formed on the upper surface of the pulsator main body 4*b* and a plurality of lower vane portions 4*a* formed on the lower surface of the pulsator main body 4*b*. The pulsator 4 stirs the washing water stored in the outer tub 3 to generate a water flow.

As shown in FIGS. 3 and 4 (B), on the inner circumferential surface 2*a*1 of the dehydration tub 2, three baffle plates (water injection pipe) 7 are provided at equal intervals (equiangular) in the circumferential direction. The baffle plates 7 serve as water-passing pipes, and correspond to the balancers of the present disclosure. Each baffle plate 7 is formed in the following manner: extending in the vertical direction from the bottom 2*c* to the upper end of the dehydration tub 2, and protruding from the inner circumferential surface 2*a*1 of the dehydration tub 2 toward the axis S1. In addition, each baffle plate 7 has a hollow shape, and has a cross-sectional shape of an arc shape. Due to such a shape, the baffle plate as the balancer also has a effect of agitating the laundry during the dehydration process. In this way, the shape of the baffle plate 7 is configured to slightly protrude toward the axis S1 of the dehydration tub 2 and is widened along the circumferential direction of the dehydration tub 2, so that the accommodating space of the dehydration tub 2 is suppressed from being narrowed.

As shown in FIGS. 2 and 3, at the lower end portion of such a baffle plate 7, an opening portion 71 with an opening in the vicinity of the bottom portion 2*c* of the dehydration tub 2, more specifically, below the pulsator main body 4*b* is formed. In addition, a horizontally elongated circulation water inlet 70 is formed at the upper end portion of the baffle plate 7. Therefore, in a washing process in which the drain valve 50*a* (see FIG. 2) is closed and the washing water is stored in the outer tub 3, as shown by the arrow in FIG. 3, the washing water stirred by the lower vane portion 4*a* of the pulsator 4 enters the opening portion 71, overflows the interior of the baffle plate 7 and is discharged from the circulation water inlet 70 so that the clothes are rinsed. In addition, by repeating this operation, the washing water circulates in the dehydration tub 2. That is, the baffle plate 7 has a function of circulating the washing water. It should be noted that, the water-passing pipe portion having the opening portion 71 and the circulation water inlet 70 and capable of performing a shower washing is also suitable for a conventional washing machine, but usually only one water-passing pipe portion is provided.

Furthermore, a partition piece 7*a* is configured inside the baffle plate 7, and the partition piece 7*a* extends from a position between a position where communicating members 5*a*1, 5*b*1, 5*c*1 described below are connected to and the circulation water inlet 70 to a close position the inner circumferential surface 2*a*1 of the dehydration tub 2. The partition piece 7*a* extends from the upper end edge of the circulation water inlet 70, and the free end 7*a*1 side of the partition piece 7*a* curves downward. A gap 7*b* (see FIG. 2) is formed between the free end 7*a*1 of such a partition piece 7*a* and the inner peripheral surface 2*a*1 of the dehydration tub 2, and the adjusted water (to be described later) supplied from the water receiving ring unit 5 flows downward through this gap 7*b*.

The water receiving ring unit 5 is a device constitutes the water injection device 1*c* of the present disclosure, and it is a device formed when annular water guide gutters 5*a*, 5*b*, 5*c* (see FIG. 4(A)) opened upward are overlapped in a three-layer manner toward the axis S1 of the dehydration tub 2 along a radial direction. As shown in FIG. 3, it is fixed to the upper end portion of the inner circumferential surface 2*a*1 of the dehydration tub 2. The number of water guide gutters 5*a*, 5*b*, 5*c* is set to be the same as the number of baffle plates 7, and a water flow passage through which adjusted water can flow to one of the baffle plates 7 is formed inside. Such a water receiving ring unit 5 has substantially the same size and shape as a known liquid balancer attached to a conventional washing machine, and in the present embodiment, it replaces a liquid balancer to be mounted at a mounting position of a general liquid balancer. Though the liquid balancer has a function of passively eliminating the unbalance of the dehydration tub 2 during dehydration, as described later, its effect is small compared with the water receiving ring unit 5 which can actively eliminate the unbalance of the dehydration tub 2.

Such a water receiving ring unit 5 is connected to the upper end portion of the baffle plate 7 through communicating members 5*a*1, 5*b*1 and 5*c*1. The communicating members 5*a*1, 5*b*1, 5*c*1 are connected to the baffle plate 7 above the circulation water inlet 70.

The nozzle unit 6 is device constituting the water injection device 1*c* of the present disclosure, and it also a device that injects the adjusted water individually into such water guide gutters 5*a*, 5*b*, 5*c*. The nozzle unit 6 includes three water injection nozzles 6*a*, 6*b*, 6*c* disposed above the water guide gutters 5*a*, 5*b*, 5*c* and water supply valves 26*a*, 26*b*, 26*c* connected to the water injection nozzles 6*a*, 6*b*, 6*c*, 26*c*. The number of the water injection nozzles 6*a*, 6*b*, 6*c* is set to be the same as that of the water guide gutters 5*a*, 5*b*, 5*c*, and they are arranged at positions where the water can be injected into each of the water guide gutters 5*a*, 5*b*, 5*c*. In this embodiment, tap water is used as the adjusted water. In addition, as the water supply valves 26*a*, 26*b*, and 26*c*, a direction switching water supply valve may also be adopted.

That is, the water injection device 1*c* according to the present disclosure is formed by a receiving ring unit and a nozzle unit.

With such a configuration of the water injection device 1*c*, in the dehydration process in which the drain valve 50*a* is opened and the washing water in the outer tub 3 is discharged from the drain port 50, the adjusted water injected into the water guide gutters 5*a*, 5*b*, 5*c* of the water receiving ring unit 5 from any one of the water injection nozzles 6*a*, 6*b* and 6*c* of the nozzle unit 6 flows into the baffle plates 7 via the communication members 5*a*1, 5*b*1, 5*c*1. For example, when the adjusted water is injected from the water injection nozzle 6*c*, as indicated by an arrow in FIG. 5, the adjusted water flows into the baffle plate 7 from the water guide gutter 5*c* via the communicating member 5*c*1. When the dehydration tub 2 is in a high-speed rotation state, the adjusted water flowing into the baffle plate 7 sticks to the inner circumferential surface 2*a*1 of the dehydration tub 2 by the centrifugal force and stays therein. As a result, the weight of the baffle plate 7 increases and the balance of the dehydration tub 2 changes. In this way, the baffle plate 7 may be a pocket baffle structure capable of storing the adjusted water by a centrifugal force. Then, when the dehydration process approaches the end and the rotation speed of the dehydration tub 2 decreases, the centrifugal force in the baffle plate 7 gradually attenuates, the adjusted water flows out of the opening portion 71 by gravity and discharges out of the outer tub 3 via the drain pipe 5. At this time, the adjusted water flows into the lower portion of the pulsator body 4*b* via the opening portion 71. Therefore, the adjusted water is drained without wetting the clothes located above the pulsator body 4*b*.

The driving portion 40 shown in FIG. 2 rotates the pulleys 15 and the conveyor belt 15*b* by the motor 10, and rotates the driving shaft 17 extending toward the bottom 2*c* of the dehydration tub 2 so as to apply the driving force to the dehydration tub 2 and the pulsator 4 to rotate the dehydration tub 2 and the pulsator 4. In the washing process, the washing machine 1 mainly rotates the pulsator 4 alone, and in the dehydrating process, the dehydration tub 2 and the pulsator 4 are integrally rotated at a high speed. A proximity switch 14 is disposed in the vicinity of one of the pulleys 15, and the passage of a mark 15*a* formed on the pulley 15 may be detected by the proximity switch 14.

FIG. 6 is a block diagram showing an electrical structure of the washing machine 1 of the present embodiment. The operation of the washing machine 1 is controlled by a control device 30 including a microcomputer. The control device 30 includes a central control part (CPU) 31 which governs the control of the entire system, and the control device 30 is connected to a memory 32. The memory stores a low-speed rotation set value (N1) required for the rotation control of the dehydration tub 2 before the dehydration operation starts, a high-speed rotation set value (N2) after the start of the dehydration operation, the unbalance amount set value (ma) during low-speed dehydration operation and the unbalance amount set value (mb) during high-speed dehydration operation. In addition, when the program stored in the memory 32 is executed by the microcomputer to carry out a predetermined operation, data etc. to be actually used for executing the above-mentioned program temporarily stored in the memory 32 by the control device 30.

The central control part 31 outputs a control signal to a rotation speed control part 33, and further outputs the control signal to a motor control part (motor control circuit) 34 to perform a control of the rotation of the motor 10. It should be noted that, the rotation speed control part 33 receives a signal indicating the rotation speed of the motor 10 from the motor control part 34 in real time to form a control element. An acceleration sensor 12 is connected to an unbalance amount detection part 35, and the acceleration sensor 12 and the proximity switch 14 are connected to an unbalanced position detection part 36.

Therefore, when the proximity switch 14 detects the marker 15*a* (See FIG. 2), the unbalance amount (M) is calculated by an unbalance amount detection part 35 according to the magnitude of the acceleration in the horizontal direction and the vertical direction from the acceleration sensor 12, and the unbalance amount is outputted to an unbalance amount determination part 37. On the other hand, an angle of the unbalance direction is calculated by the unbalanced position detection part 36 according to a signal indicating the position of the marker 15*a* inputted from the proximity switch 14, and an unbalanced position signal is outputted to a water injection control part 38.

Upon receiving the unbalance amount from the unbalance amount determination part 37 and the signal indicating the unbalanced position from the unbalanced position detection part 36, the water injection control part 38 determines whether to supply water to any one of the baffle plates 7 in the dehydration tub 2 and the amount of water to be supplied based on a control program stored in advance. Then, the selected water supply valves 26*a*, 26*b*, 26*c* are opened, and injection of the adjusted water is started. When the unbalance occurs in the dehydration tub 2, the adjusted water is injected into the water guide gutters 5*a*, 5*b*, 5*c* of the water receiving ring unit 5 from the water injection nozzles 6*a*, 6*b*, 6*c* selected based on the calculation of the unbalance amount. When the unbalance is eliminated by the baffle plate 7, the injection of the adjusted water is stopped.

It should be noted that, for example, as shown in FIG. 4(B), the water injection control portion 38 carries out a control in a manner of supplying the adjusted water to the baffle plate 7 (A) in the case in which a mass LD (X) of the laundry, which forms a main reason of unbalance, are provided between the baffle plate 7(B) and the baffle plate 7(C) of the dehydration tub 2. In addition, when a mass LD (Y) of the laundry is in the vicinity of the baffle plate 7(A), the control is performed so that the adjusted water is supplied to both the baffle plate 7(B) and the baffle plate 7(C).

Here, in the present embodiment, for the above-mentioned case that the mass LD (Y) of the laundry is located in the vicinity of one of the baffle plates 7, the case in which water injection needs to be performed into the plurality of baffles 7 in order to eliminate the unbalance will be described in details.

That is, the central control part 31 shown in FIG. 6 opens a water supply valve X and a water supply valve Z as described in the parameter table of FIG. 9. Here, in the present embodiment, by dividing into nine items as shown in FIG. 9, the determination of the unbalanced position can be divided into two cases: identifying a balancer for eliminating the unbalanced position (i.e. a baffle plate) as one unbalanced position (N) and identifying a balancer for eliminating the unbalanced position as two unbalanced positions (N).

That is, the area Y of the unbalanced position (N) that identifies one baffle required for eliminating the unbalanced position (N) is the areas P(A), P(B) and P(C). In addition, the area Y of the unbalanced position (N) required for eliminating the unbalanced position (N) is the areas P(AB), P(BA), P(BC), P(CB), P(CA) and P(AC). It should be noted that, regarding the markings of these six areas, the description order of the portions marking any two of ABC corresponds to the order of the baffle plates to be injected by the water injection device 1*c* as it is.

That is, among the characters of ABC written in these six areas, the baffle plate 7 to be injected into the water supply valve X corresponding to the first described character corresponds to the first balancer, and the baffle plate 7 to be injected into the water supply valve Z corresponding to the second character corresponds to the second balancer.

In addition, a balancer that is not described in ABC corresponds to the other balancer, and in the present embodiment, it is the baffle plate 7 closest to the unbalanced position (N).

In other words, the baffle plate 7 corresponding to the first balancer is the baffle plate 7 that is most distant from the unbalanced position (N).

Here, the control method of a washing machine according to the present embodiment includes: in a dehydration process, an unbalanced position detection for detecting an unbalanced position (N) of the washing tub 2; a balancer selection for determining the balancers that requires for water injection (i.e. a baffle plate 7) based on the unbalanced position detection; a first water injection for injecting the adjusted water into the baffle plates 7 through water supply valves X in a plurality of baffle plates when water injection is required for at least two of the baffle plates 7 in the balancer selection; an unbalance amount detection for detecting a transition M in the washing tub 1*b* during the first water injection; a water injection switching for switching the water injection of the adjusted water from the water supply valve X to the water supply valve Y when the unbalance amount detected by the unbalance amount detection turns into an increase; and a second water injection for injecting the adjusted water into the baffle plate 7 through the water injection valve Y.

Figure 7:
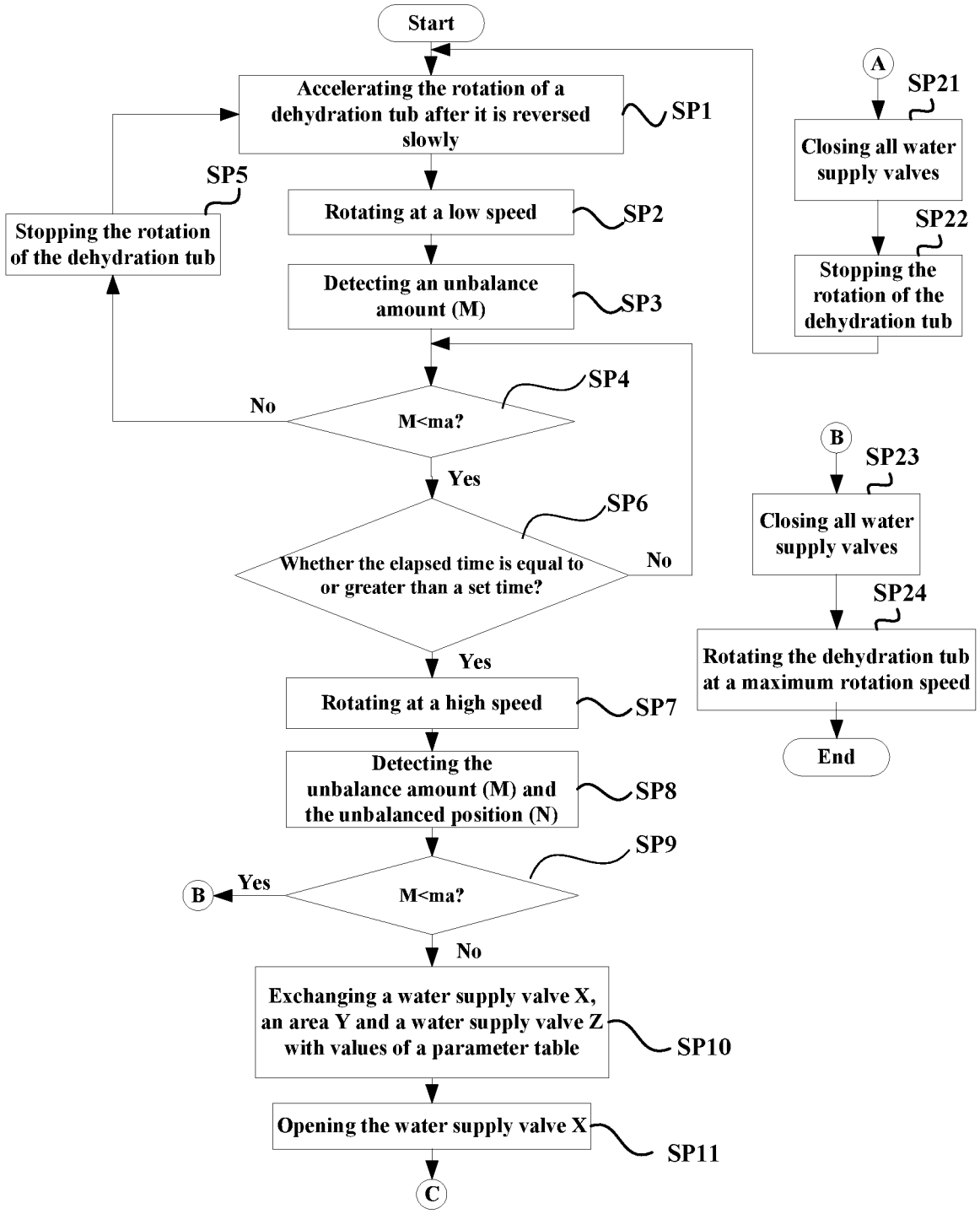
FIG. 7 is a flowchart showing the flow of control in the dehydration process of the same washing machine 1.
Figure 8:
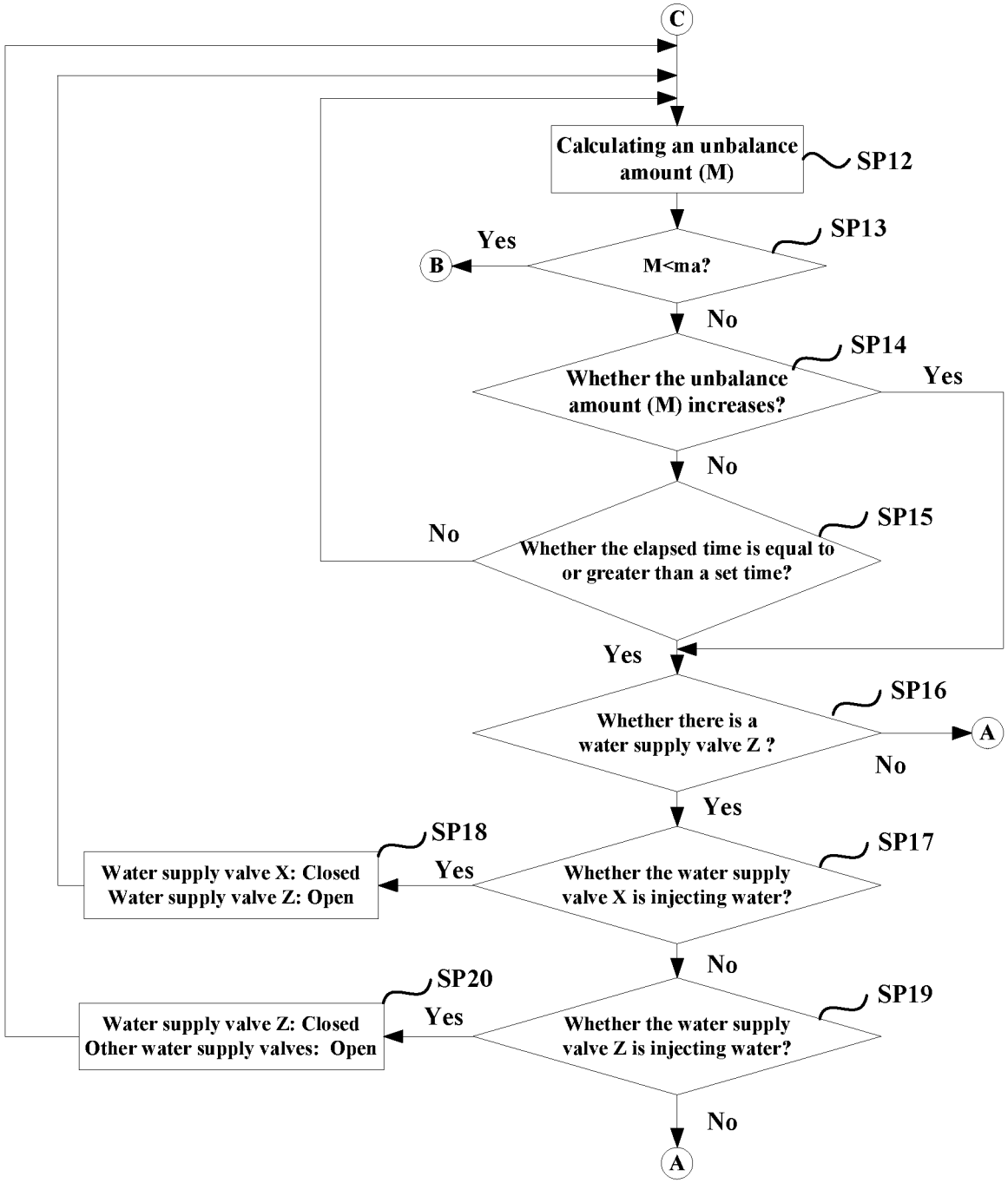
FIG. 8 is a flowchart showing the flow of control in the dehydration process of the same washing machine 1.

FIGS. 7 and 8 are flowcharts showing the control of the washing machine 1 of the present embodiment.

In the present embodiment, when the central control part 31 receives an input signal from a dehydration button (not shown) or a signal to start the dehydration process during the operation of the washing procedures, the process proceeds to SP1, and the dehydration process starts.

<SP1>

In SP1, the central control part 31 accelerates the rotation of the dehydration tub 2 after the dehydration tub 2 is reversed slowly.

<SP2>

In SP2, the central control part 31 rotates the dehydration tub 2 at a low speed based on the low-speed rotation set value (N1).

<SP3>

In SP3, the central control part 31 detects the unbalance amount (M) based on the acceleration value (the x component of the acceleration sensor) given from the acceleration sensor 12.

<SP4>

In SP4, the central control part 31 compares the unbalance amount (M) with the unbalance amount set value (ma) stored in the memory 32, and determines whether M<ma holds. When it is determined that M<ma holds, the process proceeds to SP6. On the other hand, when it is determined that M<ma does not hold, the process proceeds to SP5. Here, the unbalance amount set value (ma) is a threshold value indicating that the bias of the laundry is large to the extent that it is difficult to be eliminated even if the adjusted water is supplied to the baffle plate 7. That is, in the case of proceeding to SP5, it means that it is determined that the bias of the laundry is large to the extent that it is difficult to be eliminated even if the adjusted water is supplied to the baffle plate 7.

<SP5>

In SP5, after stopping the rotation of the dehydration tub 2, the central control part 31 returns to SP1 and repeats S1 to S4.

<SP6>

In SP6, when the central control part 31 determines that the elapsed time from the start of the low-speed rotation of the dehydration tub 2 is equal to or greater than the predetermined set time for performing the low-speed rotation processing, the central control part 31 proceeds to SP7.

<SP7>

In SP7, the central control part 31 rotates the dehydration tub 2 at a high speed based on the high-speed rotation set value (N2).

<SP8>

In SP8, the central control part 31 detects the unbalance amount (M) and the unbalanced position (N) based on the acceleration value given from the acceleration sensor 12. That is, SP8 corresponds to the unbalanced position detecting according to the present disclosure.

<SP9>

In SP9, the central control part 31 compares the unbalance amount (M) with the unbalance amount set value (mb) stored in the memory 32, and determines whether M<mb holds. When it is determined that M<mb holds, the process proceeds to SP23 to be described later. On the other hand, when it is determined that M<mb does not hold, the process proceeds to SP10. Here, the unbalance amount set value (mb) is a value smaller than the unbalance amount set value (ma), and it is a threshold value indicating that the bias of the laundry is small to the extent that noises cannot be generated even if the adjusted water is not supplied to the baffle plate 7. That is, when it is determined that the eccentric load is small or absent and noises are not generated even if water is not supplied to the baffle plate 7, the process proceeds to SP23.

<SP10>

In SP10, based on the unbalanced position (N), the central control part 31 exchanges the water supply valve X, the area Y, and the water supply valve Z shown in FIG. 9 with the values of the parameter table and stores them in, for example, the memory 32. That is, SP10 corresponds to a balancer selection according to the present disclosure.

<SP11>

In SP11, the central control part 31 opens the water supply valve X described in the parameter table of FIG. 9. That is, SP11 corresponds to the first water injection according to the present disclosure.

<SP12>

In SP12 shown in FIG. 8, the central control part 31 recalculates the unbalance amount (M) based on the acceleration value given from the acceleration sensor 12. That is, SP12 corresponds to an unbalance amount detection according to the present disclosure for detecting the transition of the unbalance amount (M) of the washing tub 1*b*. It should be noted that, in SP12, the unbalance amount (M) commonly shows a gradually reduced trend at the beginning.

<SP13>

In SP13, the central control part 31 compares the unbalance amount (M) with the unbalance amount set value (mb) stored in the memory 32, and determines whether M<mb holds. When it is determined that M<mb holds, the process proceeds to SP23 to be described later. On the other hand, if it is determined that M<mb does not hold, the process proceeds to SP14. Here, the unbalance amount set value (mb) is a value smaller than the unbalance amount set value (ma), and it is a threshold value indicating that the bias of the laundry is small to the extent that noises cannot be generated even if the adjusted water is not supplied to the baffle plate 7. In other words, when it is determined that the eccentric load is small or absent and noises are not generated even if water is not supplied to the baffle plate 7, the process proceeds to SP23.

<SP14>

In SP14, when the unbalance amount (M) detected in 12 has not turned to an increase, the central control part 31 proceeds to SP15. When it is determined that the unbalance amount (M) has turned to an increase, the process proceeds to SP16.

<SP15>

In SP15, when the central control part 31 determines that the elapsed time after the opening of the water supply valve X is equal to or greater than the set time, the process proceeds to SP16. When the elapsed time is equal to or smaller than the set time, the process returns to SP12. Here, the set time is, for example, the time it takes for the interior of one baffle plate 7 to be substantially filled with the adjusted water.

<SP16>

In SP16, the central control part 31 determines which area Y in the areas Y shown in the parameter table of FIG. 9 is the unbalanced position (N) exchanged in SP12 and stored in the memory 32. When it is determined that the unbalanced position (N) is the area Y where the water supply valve Z is not set, that is, the area P(A), P(B) or P(C), the process proceeds to SP21 to be described later. When it is determined that the unbalanced position (N) is the area Y where the water supply valve Z is set, that is, the area P (AB), P (BA), P (BC), P(CB), P(CA) or P(AC), the process proceeds to SP 17.

<SP17>

In SP 17, the central control part 31 determines whether the water is being injected by the water supply valve X. When the water is being injected by the water supply valve X, the process proceeds to SP18. When the water is not being injected by the water supply valve X, the process proceeds to SP19.

<SP18>

In SP18, the water supply valve X described in the parameter table of FIG. 9 is closed and the water supply valve Z is opened. For example, when the initial unbalanced position (N) is the area P(AB), the water supply valve X is a water supply valve 26*a* corresponding to the baffle plate 7(A), and the water supply valve Z is the water supply valve 26*b* corresponding to the baffle plate 7(B) located at a position closer to the area P (AB) than the baffle plate 7 (A) corresponding to the water supply valve 26*a*, i.e. the second position that is farthest from the area P (AB). That is, SP18 corresponds to the second water injection according to the present disclosure.

<SP19>

In SP19, the central control part 31 determines whether water is being injected by the water supply valve Z. When the water is being injected by the water supply valve Z, the process proceeds to SP20. If the water is not being injected by the water supply valve Z, the process proceeds to SP21 which will be described later.

<SP20>

In SP20, the water supply valve Z described in the parameter table of FIG. 9 is closed and other valves are opened. For example, when the initial unbalanced position (N) is the area P(AB), the water supply valve Z becomes the water supply valve 26*b* corresponding to the baffle plate 7(B), and the other valves are the water supply valves 26*c* corresponding to the baffle plate 7(C), which is located at a position that is closer to the area P(AB) than the baffle plate 7(B) corresponding to the water supply valve 26*c*, that is, at a position that is closest to the area P(AB). That is, SP20 corresponds to other water injection.

<SP21>

In SP21 shown in FIG. 7, the central control part 31 enables all the water supply valves X and Z to be in a closed state.

<SP22>

In SP22, the central control part 31 stops the rotation of the dehydration tub 2 and then returns to SP1.

In such way, when it is determined that the unbalanced load is so large as not to be eliminated by the water supply to the baffle plate 7, the processes of SP21 and SP22 are performed and the dehydration process is restarted from the beginning.

<SP23>

In SP23 shown in FIG. 7, the central control part 31 enables all the water supply valves X, Z to be in a closed state.

<SP24>

In SP24, the central control part 31 rotates the dehydration tub 2 at the maximum rotation speed for a predetermined time to perform a dehydration process. Thereafter, the dehydration process is terminated.

Figure 10:
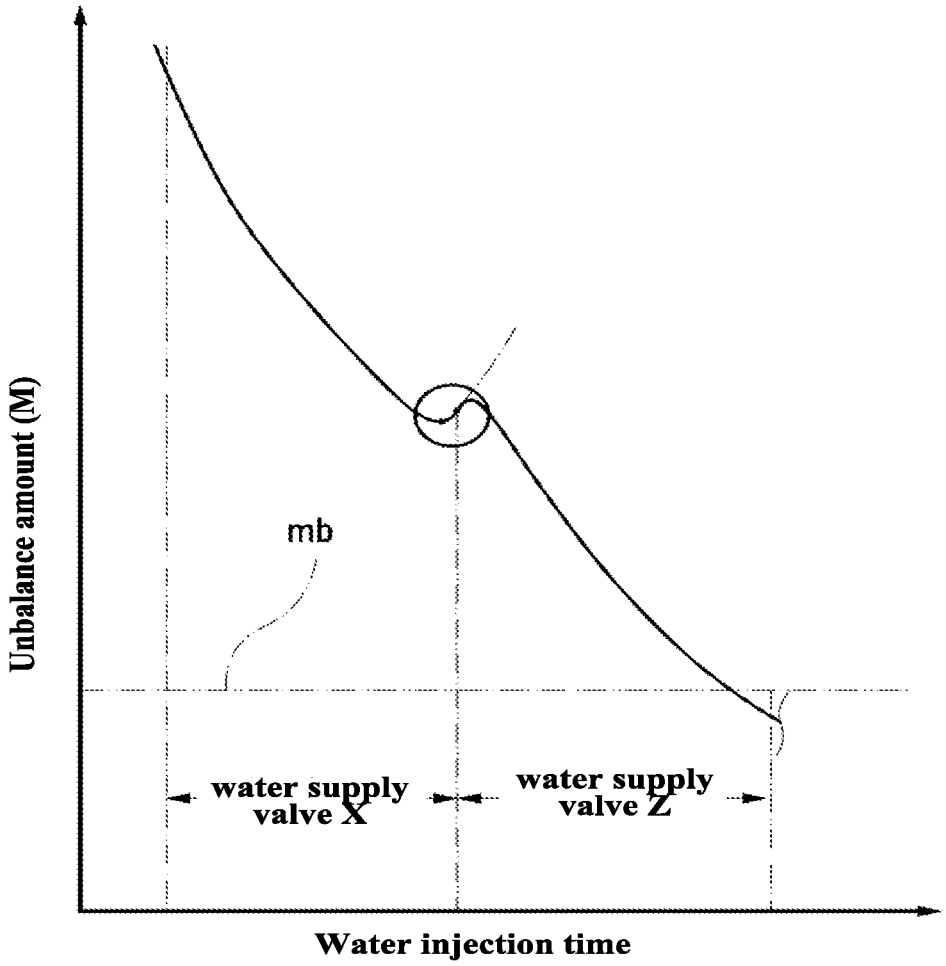
FIG. 10 is a diagram showing a transition of an unbalance amount (M) in the control of the same washing machine 1.

In addition, in FIG. 10, the change of a series of eccentricity from the above SP11 through SP18 to SP23 is shown. In this way, first, regarding the curve indicating the eccentricity, i.e. the unbalance amount (M), the portion indicated by the imaginary line shows the change that the water injection into the baffle plate injected by the water supply valve X exceeds the required amount. In the present embodiment, by providing SP14 of detecting the time point at which the unbalance amount (M) rises and switching the water injection valve at the time point, it is possible to quickly inject the water into the required baffle plate 7 without increasing additional time for the unbalance amount (M).

In addition, in the present embodiment, in the case in which the unbalance amount (M) still is not smaller than an unbalance amount set value (mb) at the time of carrying out a water injection (corresponding to injecting water to the second balancer) by the water supply valve Z, the third water supply valve which has not injected water is opened. As described above, in this embodiment, when the water is injected into a plurality of baffle plates 7, the water is injected in order from the baffle plate 7 that is the most distant from the unbalanced position (N) to the baffle plate 7 that is closest to the unbalanced position (N). Then, the baffle plate is switched depending on whether the unbalance amount (M) turns into an increase or a predetermined time has elapsed, and when the unbalance amount (M) is smaller than the imbalance amount set value (mb) by a series of water injections, the process is shifted to the operation described below. When the unbalance amount (M) is not smaller than the imbalance amount set value (mb), that is, when the result in SP19 is NO, the operation is started again from the beginning of the dehydration process.

Thereafter, when the unbalance amount (M) becomes equal to or smaller than the set value, the dehydration tub 2 is accelerated to a high-speed spinning rotation and the dehydration is performed. When the dehydration is finished and deceleration of the dehydration tub 2 is started and the centrifugal force falls below the gravitational acceleration, the adjusted water in the baffle plate 7 flows downward from the opening 71 and is discharged.

According to the flow of the dehydration process by the above control method, even if the water injection is required for a plurality of baffle plates 7, the unbalance state is eliminated promptly and easily. Therefore, the washing machine 1 can be designed as follows: the occurrence of vibrations and noises can be prevented and the delay of the operation time can be effectively avoided regardless of the specific stage from the start to the end of the dehydration operation.

As described above, for the control method of the washing machine 1 of the present disclosure, at the time point of SP14 that the unbalance amount (M) rises during the water injection into the baffle plate 7 that performs the water injection first, the water injection is switched for the next baffle plate 7. By performing above control, the time required for water injection can be made suitable for eliminating the unbalance even if a plurality of balancers needs to be filled with water. In particular, it effectively avoids unnecessary increase in the time for water injection into the baffle plate 7 that serves as the first balancer. As a result, an excessively long time required for eliminating the unbalance is avoided, and the dehydration process is performed smoothly.

That is, according to the present embodiment, even if the uneven distribution of laundry in the dehydration tub 2 occurs in the dehydration process, the unbalance of the dehydration tub 2 in the washing tub 1*b* is eliminated without slowing or stopping the rotation. Generation of vibrations and noises due to the eccentricity of the dehydration tub 2 can be suppressed and a delay in operation time can be effectively avoided. As a result, since the time required for the user's laundry is not delayed, it can contribute to an effective utilization of the user's time and an improvement on the circulation efficiency of the laundromat.

In addition, the first balancer, i.e. the baffle plate 7 supplied with water by the water supply valve X, is the baffle plate 7 which is located at a position having a furthest distance from the unbalanced position (N). Thus, the unbalance amount (M) is promptly reduced by injecting water into the baffle plate 7 which most contributes to the reduction of the unbalance amount (M), and meanwhile, the water is injected for necessary time by SP18 which is the water injection switching, thereby achieving the elimination of the unbalance more rapidly.

Further, in the present embodiment, when the increase in the unbalance amount (M) is not detected by SP14, SP15, that is, the time switching as described above, is also configured. Thus, even if the water injected to the first balancer (i.e. the baffle plate 7 in which water is injected from the water supply valve X) have a low degree of actual eliminating the unbalance, an excessively long time for the water injection is avoided, and it contributes to further eliminate the unbalance.

Further, in the present embodiment, since the baffle plate 7 for agitating the laundry which was originally mounted on the washing machine 1 is utilized as a balancer, by effectively utilizing the existing configuration, the upsizing of the device is avoided, and the increasing in the number of parts to be manufactured also can be effectively avoided, which also contributes to manufacturing with a higher efficiency.

In addition, in the present embodiment, the plurality of baffle plates 7 serving as balancers are provided at equal angular intervals on the inner circumferential surface 2*a*1 of the dehydration tub 2. Thus, a control from the determination of unbalanced position (N) to the determination of the water supply valve X is simplified, and the efficient elimination of the unbalance is achieved at the same time.

Although one embodiment of the present disclosure has been described above, the configuration of the present embodiment is not limited to the one described above, and various modifications are possible.

For example, in the above-described embodiment, an example in which the present disclosure is applied to a so-called vertical type fully automatic washing machine as a washing machine has been disclosed, but, the control method according to the present disclosure undoubtedly can be used for a home-use diagonal drum-type fully automatic washing machine and can be widely applied to a horizontal type washer-dryer in a store of a laundromat.

Further, for example, in the above embodiment, the water receiving ring unit 5 is constituted by three water guide gutters 5*a*, 5*b*, 5*c*, and correspondingly, three baffle plates 7 are provided. However, the present disclosure is not limited to this, but it just suffices that three or more baffle plates 7 are provided and the number and the configurations of the water guide gutters 5*a*, 5*b*, 5*c* are the same as those of the baffle plates 7.

Further, the water receiving ring unit 5 may have a configuration in which a plurality of water guide gutters 5*a*, 5*b*, 5*c* is stacked in the vertical direction, so that a horizontal width of the water receiving ring unit 5 is narrowed and the opening of the dehydration tub 2 can be expanded.

Further, the baffle plate 7 may have a shape that expands upward or downward depending on the operation (situation) of the washing machine 1.

Other configurations can be modified in various ways without departing from the spirit of the present disclosure.

DESCRIPTION OF THE SYMBOLS

1: Washing machine; 1*b*: Washing tub; 1*c*: Water injection device; 2*a*1: Inner peripheral surface (of a dehydration tub); 7: Balancer (baffle plate); S1: Axis; SP8: Unbalanced position detection; SP10: Balancer selection; SP11: First water injection; SP14, SP16, SP17, SP18: Water injection switching; SP15, SP16, SP17, SP18: Time switching; SP18: Second water injection

What is claimed is:

1. A method of controlling a washing machine, wherein the washing machine comprises:

three or more hollow balancers provided with different angular phases around an axis at an inner circumferential surface of a washing tub; and a water injection device for injecting adjusted water into each of the balancers individually, wherein the method of controlling the washing machine comprises:

in a dehydration process, detecting an unbalanced position of the washing tub;

determining the balancers that require water injection based on the detection of an unbalanced position;

when water injection is required for at least two of the balancers, injecting the adjusted water into an arbitrary first one of the at least two of the balancers;

detecting a transition of an unbalance amount of the washing tub during the injection of the adjusted water;

switching the water injection of the adjusted water from the first one of the at least two of the balancers to a second one of the at least two of the balancers when the unbalance amount detected increases; and injecting the adjusted water into the second one of the at least two of the balancers.

2. The method of controlling the washing machine according to claim 1, wherein the first one of the at least two balancers is located at a position having a furthest distance from the unbalanced position.

3. The method of controlling the washing machine according to claim 2, comprising:

switching the water injection of the adjusted water from the first one of the at least two balancers to the second one of the at least two balancers when a predetermined time has elapsed from the first water injection to the water injection switching.

4. The method of controlling the washing machine according to claim 2, wherein the each of the balancers is a baffle plate protruding from the inner circumferential surface of the washing tub and capable of stirring a laundry.

5. The method of controlling the washing machine according to claim 2, wherein the balancers are provided at equal angle intervals along the inner circumferential surface of the washing tub.

6. The method of controlling the washing machine according to claim 1, comprising:

switching the water injection of the adjusted water from the first one of the at least two balancers to the second one of the at least two balancers when a predetermined time has elapsed from the first water injection to the water injection switching.

7. The method of controlling the washing machine according to claim 1, wherein the each of the balancers is a baffle plate protruding from the inner circumferential surface of the washing tub and capable of stirring a laundry.

8. The method of controlling the washing machine according to claim 1, wherein the balancers are provided at equal angle intervals along the inner circumferential surface of the washing tub.

* * * * *